US005647771A

United States Patent [19]

Shu

[11] Patent Number: 5,647,771

[45] Date of Patent: Jul. 15, 1997

[54] SOCKET STRUCTURE USED FOR DECORATION LIGHT BULBS

[76] Inventor: Kuo Fen Shu, 10, Lane 198, Chung Cheng Road, Chinchu, Taiwan

[21] Appl. No.: 433,216

[22] Filed: May 2, 1995

[51] Int. Cl.[6] ..... H01R 17/00

[52] U.S. Cl. ..... 439/699.2; 439/611

[58] Field of Search ..... 439/617–619, 439/638, 417–419, 611

[56] References Cited

U.S. PATENT DOCUMENTS 5,120,233 6/1992 Mikola ..... 439/619
5,331,529 7/1994 Huang ..... 439/619
5,339,232 8/1994 Lin ..... 439/419
5,443,399 8/1995 Jing et al. ..... 439/619

*Primary Examiner*—David L. Pirlot
*Attorney, Agent, or Firm*—Morton J. Rosenberg; David I. Klein

[57] ABSTRACT

The present invention relates to an improved socket structure used for Christmas decoration light bulbs, mainly comprising a bulb seat having an opening provided at both sides thereof and a socket shell having two corresponding protrusions disposed on the internal wall surface thereof. When the bulb seat together with a light bulb is inserted into the socket shell these two protrusions each extend into an opening to clamp the light bulb, reaching a reliably and securely united state.

1 Claim, 4 Drawing Sheets

SOCKET STRUCTURE USED FOR DECORATION LIGHT BULBS

SUMMARY OF THE INVENTION

Average Christmas decoration light bulb series make use of several small light bulbs and sockets connected in series or in parallel for a decorative illumination purpose. One of the malfunctions that happen most easily in such a light bulb series is an unsecured bulb connection, which often leads to loosening and poor contact between bulbs and sockets during packing and transportation, resulting in failure to light on and a product fault.

In view of this, the invention is to provide an improved socket structure that uses an ingenious engaging means to hold securely the light bulb seated therein to eliminate any loosening and reduce the possibility of malfunctions.

BRIEF DESCRIPTION OF THE DRAWINGS

The structure, features, and advantages of the invention will be explained in the following detailed description with reference to the accompanying drawings.

DETAILED DESCRIPTION OF A PREFERRED EMBODIMENT

Figure 1:
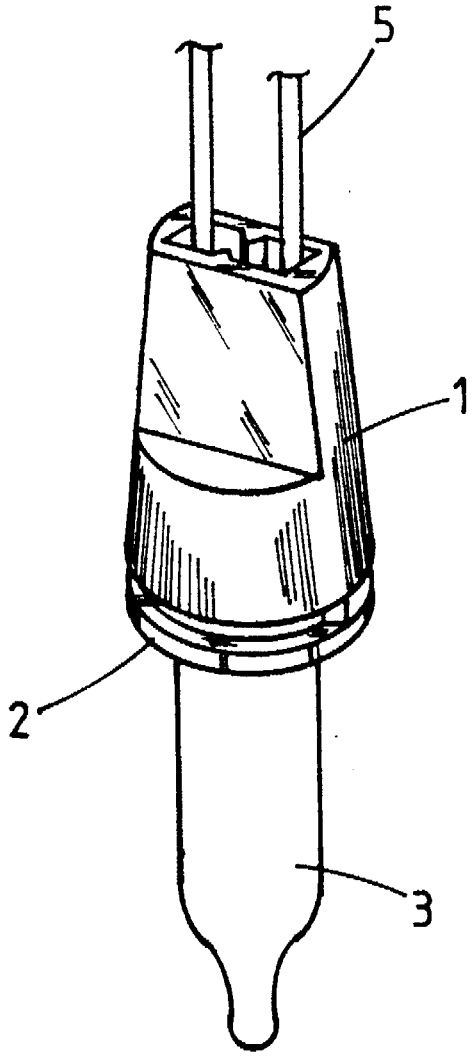
FIG. 1 is a perspective view of an embodiment of a bulb socket according to the present invention.
Figure 2:
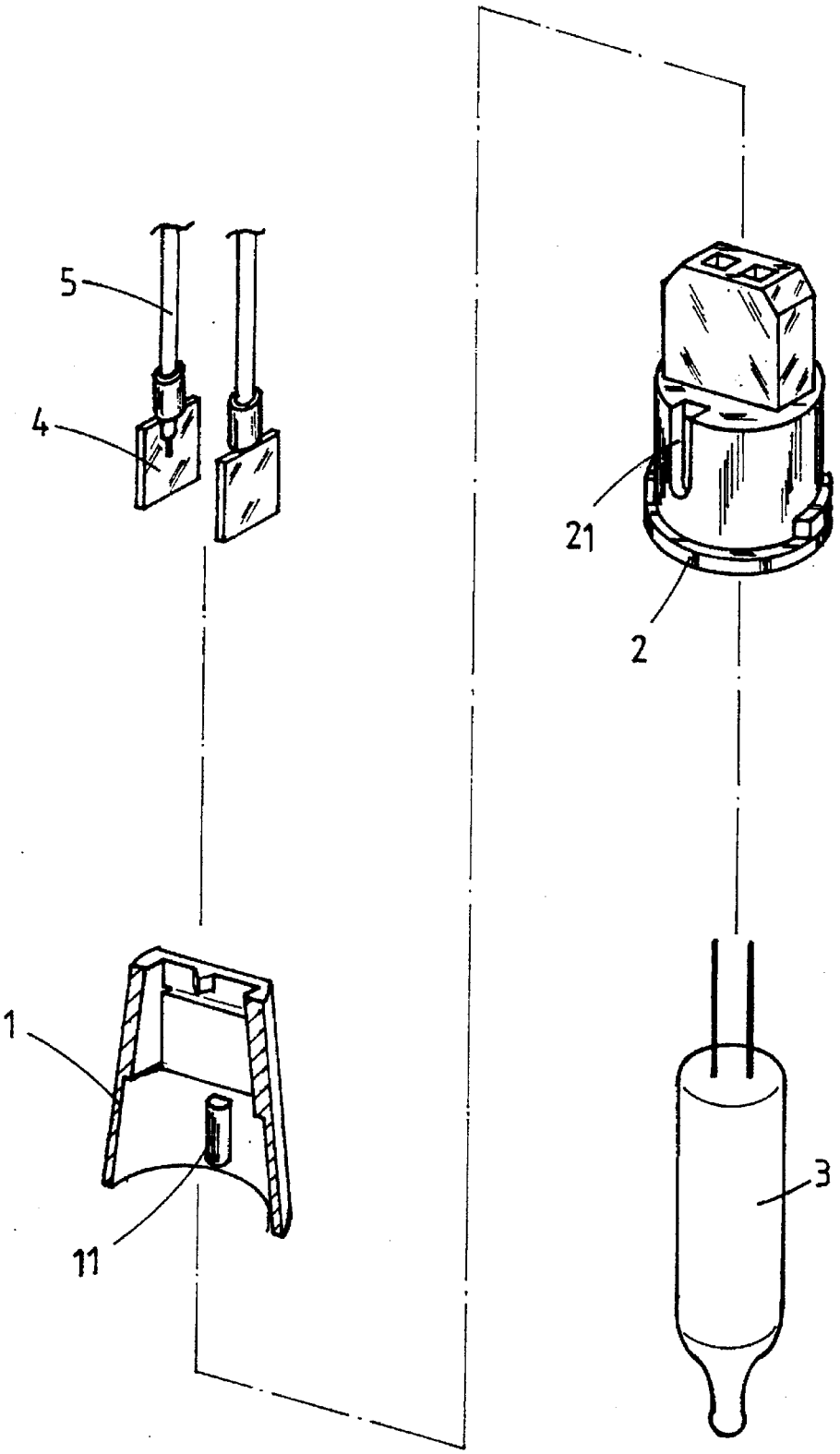
FIG. 2 is an exploded view of the bulb socket of FIG. 1.
Figure 3:
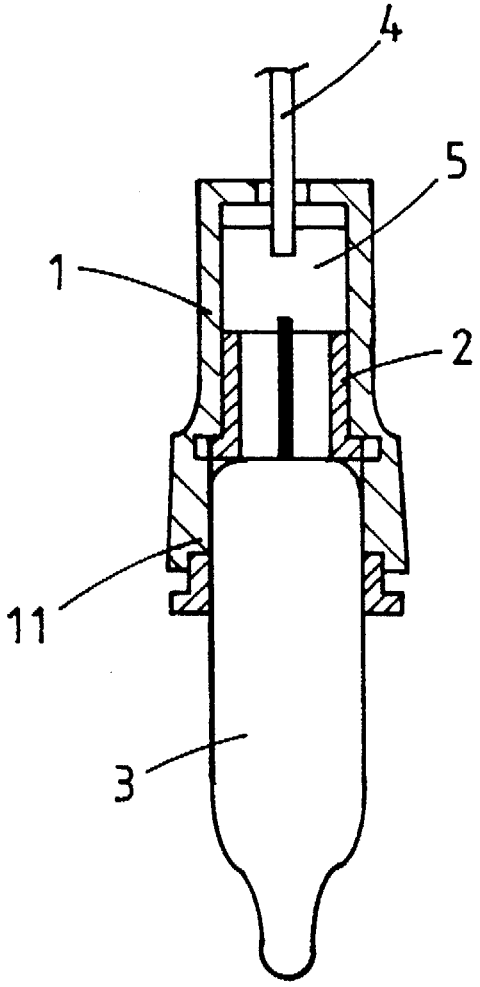
FIG. 3 is a cross-sectional view of the bulb socket of FIG. 1.
Figure 4:
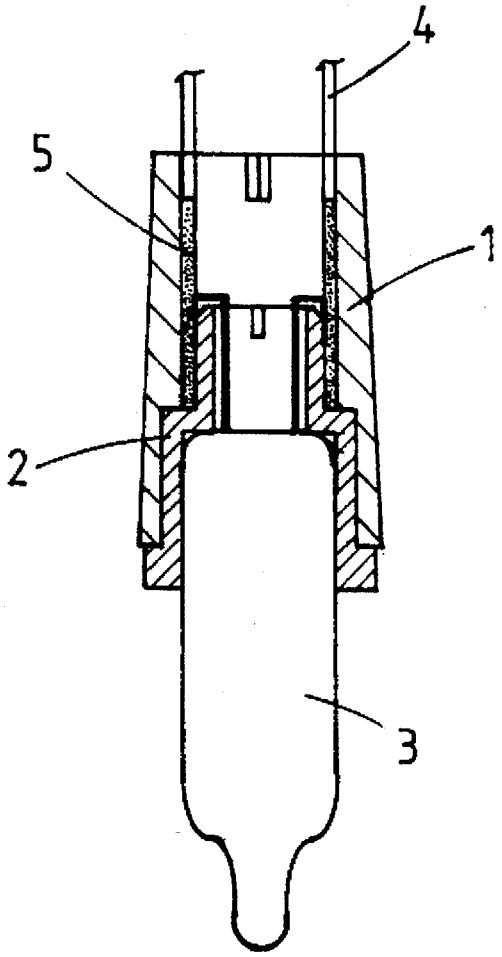
FIG. 4 is another cross-sectional view of the bulb socket of FIG. 1.

With reference to the accompanying drawings, the socket structure according to the invention includes a socket shell (1), a bulb seat (2) capable of holding average decorative light bulbs (3), and two conductor wire assemblies each consisting of a conductor plate (4) and an electric wire (5). The bulb seat (2) is provided with an opening (21) at both sides and the socket shell (1) has corresponding protrusions (11) on its inner wall surface, which is arranged in such a manner that when the bulb seat (2) is inserted into the socket shell (1) the protrusions (11) extend into the openings (21).

In the arrangement two conductor wire assemblies are first set in the socket shell (1) with electric wires passing through voids on the bottom of the socket shell and a light bulb (3) is placed into the bulb seat (2). Then the seat (2) together with the light bulb therein is further put into the socket shell (1), with the protrusions (11) of the socket shell (1) inserted into the openings (21) of the bulb seat (2) to hold securely the bulb (3). Thus the light bulb structure can reach a reliable clamping effect without danger of loosening. In the addition, engagement between the openings (21) of the bulb seat (2) and corresponding protrusions (11) of the socket shell (1) can enhance the effectiveness of the socket structure, providing the advantages of convenience in assembling and prevention of relative rotation between the seat and the socket shell.

From the description above it can be seen that the invention indeed provides a safe and reliable bulb socket structure that makes use of an ingenious connecting means to hold securely a bulb therein to reduce the possibility of loosening and malfunction and has originality and usefulness. We hereby ask for a granting of patent to us.

What is claimed is:

1. An improved socket structure for decorative light bulbs, comprising:

a socket shell formed by a tubular wall having an inner surface circumscribing an open bore, said tubular wall having a pair of protrusions formed on opposing sides of said inner surface and extending into said open bore;

a bulb seat insertable within said open bore of said socket shell, said bulb seat having a cavity formed by an outer wall for receiving a decorative light bulb therein, said bulb seat having a pair of apertures formed in a bottom portion thereof in open communication with said cavity for passage of a respective pair of wire leads of the light bulb therethrough, said outer wall having a pair of elongated through openings formed on opposing sides of an exterior surface thereof and adapted to respectively tightly receive said protrusions therein when said bulb seat is inserted into said open bore of said socket shell, said protrusions extending through said elongated through openings for securely holding the light bulb within said bulb seat and preventing rotation of said bulb seat relative to said socket shell; and, a pair of conductor plates disposed within said open bore of said socket shell for respective electrical contact with the pair of wire leads of the light bulb, each of said conductor plates being electrically coupled to a wire passing through an opening formed in a bottom portion of said socket shell.

* * * * *